US007160504B2

(12) United States Patent
Tanaka

(10) Patent No.: US 7,160,504 B2
(45) Date of Patent: Jan. 9, 2007

(54) ALLOY TYPE THERMAL FUSE AND FUSE ELEMENT THEREOF

(75) Inventor: Yoshiaki Tanaka, Osaka (JP)

(73) Assignee: Uchihashi Estec Co., Ltd., Osaka (JP)

( * ) Notice: Subject to any disclaimer, the term of this patent is extended or adjusted under 35 U.S.C. 154(b) by 49 days.

(21) Appl. No.: 10/379,324

(22) Filed: Mar. 4, 2003

(65) Prior Publication Data

US 2003/0170140 A1 Sep. 11, 2003

(30) Foreign Application Priority Data

Mar. 6, 2002 (JP) ..... P2002-059863

(51) Int. Cl.
*C22C 28/00* (2006.01)
*H01H 37/76* (2006.01)

(52) U.S. Cl. ..... 420/555; 337/416; 228/56.3; 148/400

(58) Field of Classification Search ..... 148/400; 228/56.3; 420/555; 337/416
See application file for complete search history.

(56) References Cited

U.S. PATENT DOCUMENTS

| | | | | |
|---|---|---|---|---|
| 4,581,674 | A | | 4/1986 | Brzozowski |
| 5,514,912 | A | * | 5/1996 | Ogashiwa ..... 257/784 |
| 6,064,293 | A | | 5/2000 | Jungst et al. |
| 6,222,438 | B1 | | 4/2001 | Horibe et al. |
| 6,774,761 | B1 | | 8/2004 | Tanaka |
| 6,819,215 | B1 | | 11/2004 | Tanaka |

FOREIGN PATENT DOCUMENTS

| | | | |
|---|---|---|---|
| JP | 63-262438 | A | 10/1988 |
| JP | 03-236130 | A | 10/1991 |
| JP | 03236130 | * | 10/1991 |
| JP | 6-325670 | A | 11/1994 |
| JP | 7-66730 | B2 | 7/1995 |
| JP | 3226213 | B2 | 8/2001 |
| JP | 2001-266273 | A | 9/2001 |
| JP | 2001-266724 | A | 9/2001 |
| JP | 2001-291459 | A | 10/2001 |
| JP | 2001-325867 | A | 11/2001 |
| JP | 2002-025404 | A | 1/2002 |

* cited by examiner

*Primary Examiner*—Sikyin Ip
(74) *Attorney, Agent, or Firm*—Akin Gump; Strauss Hauer & Feld, LLP

(57) ABSTRACT

The invention provides a thermal fuse and a fuse element of the low-melting fusible alloy type. The fuse element has an alloy composition in which a total of 0.01 to 7 weight parts of at least one selected from the group consisting of Au, Bi, Cu, Ni, and Pd is added to 100 weight parts of a composition of 100% In, that of 90 to 99.9% In and 0.1 to 10% Ag, or that of 95 to 99.9% In and 0.1 to 5% Sb. As a result, the operating temperature is in the range of 135 to 160° C., requests for environment conservation can be satisfied, the diameter of the fuse element can be made very thin or reduced to about 300 μmϕ, and the thermal stability can be satisfactorily guaranteed.

4 Claims, 3 Drawing Sheets

ALLOY TYPE THERMAL FUSE AND FUSE ELEMENT THEREOF

FIELD OF THE INVENTION

The present invention relates to an alloy type thermal fuse, more particularly to improvement in an alloy type thermal fuse of an operating temperature of 135 to 160° C., and also to a fuse element which constitutes such a fuse, and which is made of a low-melting fusible alloy.

DESCRIPTION OF THE RELATED ART

In a conventional alloy type thermal fuse, a low-melting fusible alloy piece to which a flux is applied is used as a fuse element. Such a thermal fuse is mounted on an electric apparatus to be protected. When the electric apparatus abnormally generates heat, a phenomenon occurs in which the low-melting fusible alloy piece is liquefied by the generated heat, the molten metal is spheroidized by the surface tension under the coexistence with the flux that has already melted, and the alloy piece is finally broken as a result of advancement of the spheroidization, whereby the power supply to the apparatus is interrupted.

The first requirement which is imposed on such a low-melting fusible alloy is that the solid-liquid coexisting region between the solidus and liquidus lines is narrow. In an alloy, usually, a solid-liquid coexisting region exists between the solidus and liquidus lines. In this region, solid-phase particles are dispersed in a liquid phase, so that the region has also the property similar to that of a liquid phase, and therefore the above-mentioned breakage due to spheroidization may occur. As a result, there is the possibility that a low-melting fusible alloy piece is spheroidized and broken in a temperature range (indicated by $\Delta T$) which is lower than the liquidus temperature (indicated by T), and which belongs to the solid-liquid coexisting region. Therefore, a thermal fuse in which such a low-melting fusible alloy piece is used must be handled as a fuse which operates at a fuse element temperature in a range of $(T-\Delta T)$ to T. As $\Delta T$ is smaller, or as the solid-liquid coexisting region is narrower, the operating temperature of a thermal fuse is less dispersed, so that a thermal fuse can operate at a predetermined temperature in a correspondingly strict manner. Therefore, an alloy which is to be used as a fuse element of a thermal fuse is requested to have a narrow solid-liquid coexisting region.

The second requirement which is imposed on such a low-melting fusible alloy is that the electrical resistance is low. When the temperature rise by normal heat generation due to the resistance of the low-melting fusible alloy piece is indicated by $\Delta T'$, the operating temperature is substantially lower by $\Delta T'$ than that in the case where such a temperature rise does not occur. Namely, as $\Delta T'$ is larger, the operation error is substantially larger. Therefore, an alloy which is to be used as a fuse element of a thermal fuse is requested to have a low specific resistance.

A thermal fuse is repeatedly heated and cooled by heat cycles of an apparatus. During the heat cycles, recrystalization of a fuse element is promoted. When the ductility of the fuse element is excessively large, larger distortion (slip) occurs in the interface between different phases in the alloy structure. When the distortion is repeated, a change in sectional area and an increase of the length of the fuse element are extremely caused. As a result, the resistance of the fuse element itself becomes unstable, and the thermal stability cannot be guaranteed. Therefore, also the thermal stability must be emphasized as a further requirement which is imposed on such a low-melting fusible alloy.

In a fuse element of a thermal fuse of an operating temperature of 135 to 160° C., the solid-liquid coexisting region must be in the vicinity of 140 to 160° C., and the above-mentioned $\Delta T$ (the temperature range belonging to the solid-liquid coexisting region) must be within an allowable range (not larger than 4° C.). As an alloy of a low specific resistance and not containing Pc, Cd, Hg, or Tl that is a metal seemed to be harmful to the ecological system, so as to be suitable to environment conservation which is a recent global request, known are, for example, In (melting point: 157° C.), an In—Sb alloy (99% In, and 1% Sb (% means a weight percent (the same is applicable in the following description))) which is eutectic at 155° C., and an In—Ag alloy (97% In, and 3% Ag) which is eutectic at 141° C. Since such an alloy contains In as the main component, however, the alloy is so ductile that it is hardly subjected to a process of drawing into a thin wire of about 300 μmϕ, and hence can hardly cope with the miniaturization of a thermal fuse. Moreover, such an alloy has a small elastic limit. Therefore, a fuse element is caused to yield by thermal stress due to heat cycles, and a slip occurs in the alloy structure. As a result of repetition of such a slip, the sectional area and the length of the fuse element are changed, so that the resistance of the element itself is unstable and the thermal stability cannot be guaranteed.

It is an object of the invention to provide an alloy type thermal fuse in which, although In is contained as the main component of the alloy composition of a fuse element from the viewpoints of an operating temperature of 135 to 160° C., environment conservation, and a low specific resistance, the diameter of the fuse element can be made very thin or reduced to about 300 μmϕ, and the thermal stability can be satisfactorily guaranteed.

SUMMARY OF THE INVENTION

In one embodiment of the present invention, the alloy type thermal fuse comprises a fuse element having an alloy composition in which a total of 0.01 to 7 weight parts of at least one selected from the group consisting of Au, Bi, Cu, Ni, and Pd is added to 100 weight parts of In.

In another preferred embodiment of the present invention, the alloy type thermal fuse or the fuse element has an alloy composition in which a total of 0.01 to 7 weight parts of at least one selected from the group consisting of Au, Bi, Cu, Ni, and Pd is added to 100 weight parts of a composition of 90 to 99.9% In and 0.1 to 10% Ag.

In a further preferred embodiment of the present invention, the alloy type thermal fuse is a thermal fuse in which a fuse element is made of a low-melting fusible alloy, wherein the low-melting fusible alloy has an alloy composition in which a total of 0.01 to 7 weight parts of at least one selected from the group consisting of Au, Bi, Cu, Ni, and Pd is added to 100 weight parts of a composition of 95 to 99.9% In and 0.1 to 5% Sb.

In the above, the alloy compositions are allowed to contain inevitable impurities which are produced in productions of metals of raw materials and also in melting and stirring of the raw materials.

DETAILED DESCRIPTION OF THE DRAWINGS

In the alloy type thermal fuse of the invention, a circular wire having an outer diameter of 200 to 600 μmϕ, preferably, 250 to 350 μmϕ, or a flat wire having the same sectional area as that of the circular wire may be used as a fuse element.

The fuse element is made of an alloy having a composition in which a total of 0.01 to 7 weight parts of at least one selected from the group consisting of Au, Bi, Cu, Ni, and Pd is added to 100 weight parts of a composition of 100% In, that of 90 to 99.9% In and 0.1 to 10% Ag, or that of 95 to 99.9% In and 0.1 to 5% Sb. It is a matter of course that: the alloy has a melting point by which the operating temperature can be set to 135 to 160° C.; the width ΔT of the solid-liquid coexisting region is 4° C. or smaller, so that dispersion of the above-mentioned operating temperature range can be sufficiently reduced; the alloy contains no harmful metal, so that it can cope with environment conservation; and the alloy has a low specific resistance, so that an operation error due to Joule's heat can be satisfactorily prevented from occurring. Moreover, an intermetallic compound of at least one selected from the group consisting of Au, Bi, Cu, Ni, and Pd, and In of large ductility is produced, and an intercrystalline slip is caused to hardly occur by a wedge effect due to the intermetallic compound, whereby the thermal stability against the above-mentioned heat cycles is guaranteed, and the alloy is provided with sufficient strength against a drawing process to enable the alloy to be subjected a drawing process into a very thin wire of about 300 μmϕ.

The fuse element of the thermal fuse of the invention can be produced by drawing a base material of an alloy, and used with remaining to have a circular shape or with being further subjected to a compression process to be flattened.

Figure 1:
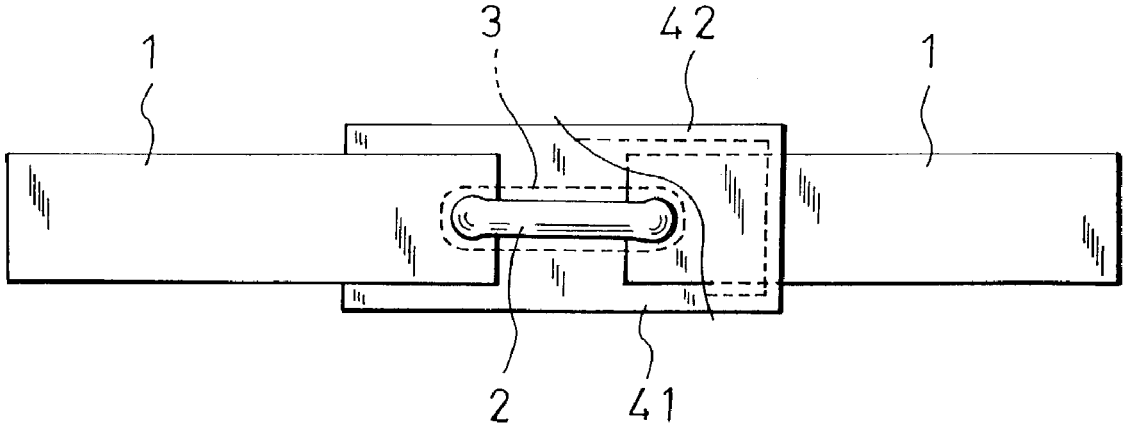
FIG. 1 is a view showing an example of the alloy type thermal fuse of the invention.

FIG. 1 shows a tape-like alloy type thermal fuse according to the invention. In the fuse, strip lead conductors 1 having a thickness of 100 to 200 μm is fixed by an adhesive agent or fusion bonding to a plastic base film 41 having a thickness of 100 to 300 μm. A fuse element 2 having a diameter of 250 to 500 μmϕ is connected between the strip lead conductors. A flux 3 is applied to the fuse element 2. The flux-applied fuse element is sealed by means of fixation of a plastic cover film 42 having a thickness of 100 to 300 μm by an adhesive agent or fusion bonding.

The alloy type thermal fuse of the invention may be realized in the form of a fuse of the case type, the substrate type, or the resin dipping type.

Figure 2:
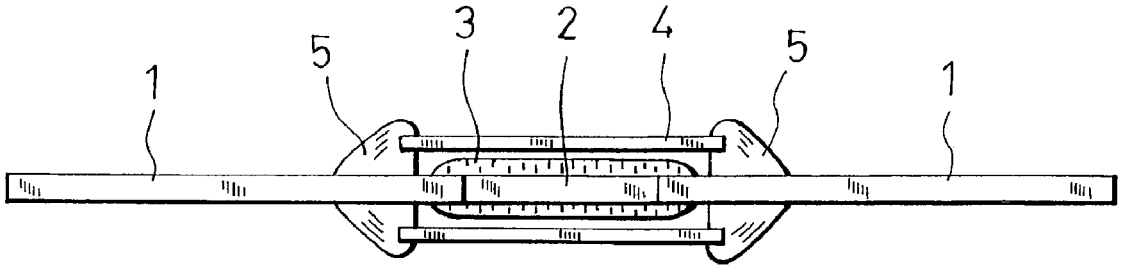
FIG. 2 is a view showing another example of the alloy type thermal fuse of the invention.

FIG. 2 shows a fuse of the cylindrical case type. A low-melting fusible alloy piece 2 is connected between a pair of lead wires 1, and a flux 3 is applied onto the low-melting fusible alloy piece 2. The flux-applied low-melting fusible alloy piece is passed through an insulating tube 4 which is excellent in heat resistance and thermal conductivity, for example, a ceramic tube. Gaps between the ends of the insulating tube 4 and the lead wires 1 are sealingly closed by a cold-setting adhesive agent 5 such as an epoxy resin.

Figure 3:
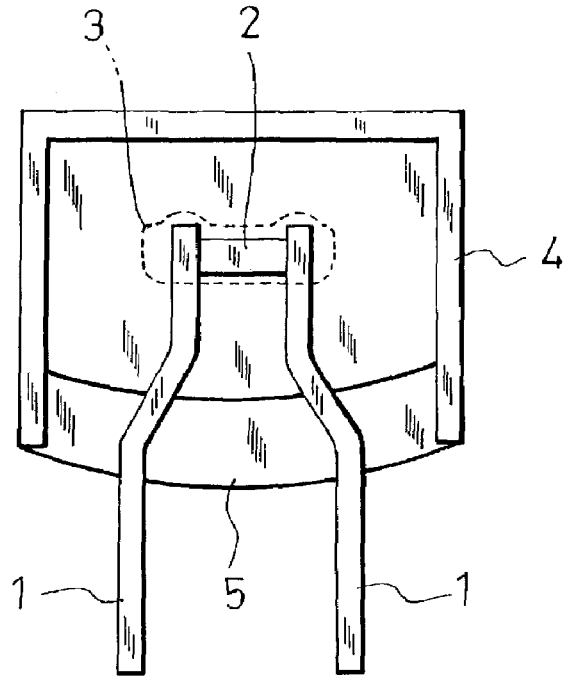
FIG. 3 is a view showing a further example of the alloy type thermal fuse of the invention.

FIG. 3 shows a fuse of the radial case type. A fuse element 2 is bonded between tip ends of parallel lead conductors 1 by welding, and a flux 3 is applied to the fuse element 2. The flux-applied fuse element is enclosed by an insulating case 4 in which one end is opened, for example, a ceramic case. The opening of the insulating case 4 is sealingly closed by a sealing agent 5 such as an epoxy resin.

Figure 4:
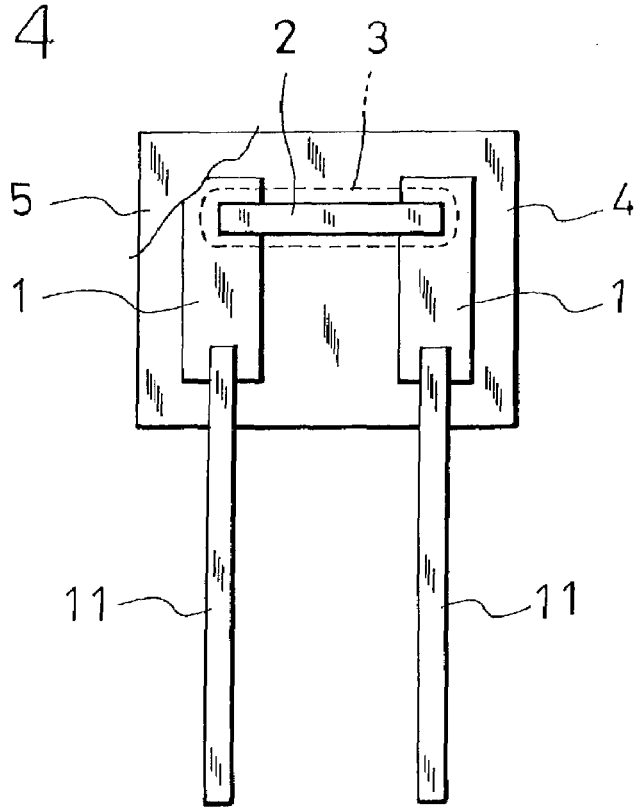
FIG. 4 is a view showing a still further example of the alloy type thermal fuse of the invention.

FIG. 4 shows a fuse of the substrate type. A pair of film electrodes 1 are formed on an insulating substrate 4 such as a ceramic substrate by printing of conductive paste (for example, silver paste). Lead conductors 11 are connected respectively to the electrodes 1 by welding or the like. A fuse element 2 is bonded between the electrodes 1 by welding, and a flux 3 is applied to the fuse element 2. The flux-applied fuse element is covered by a sealing agent 5 such as an epoxy resin.

Figure 5:
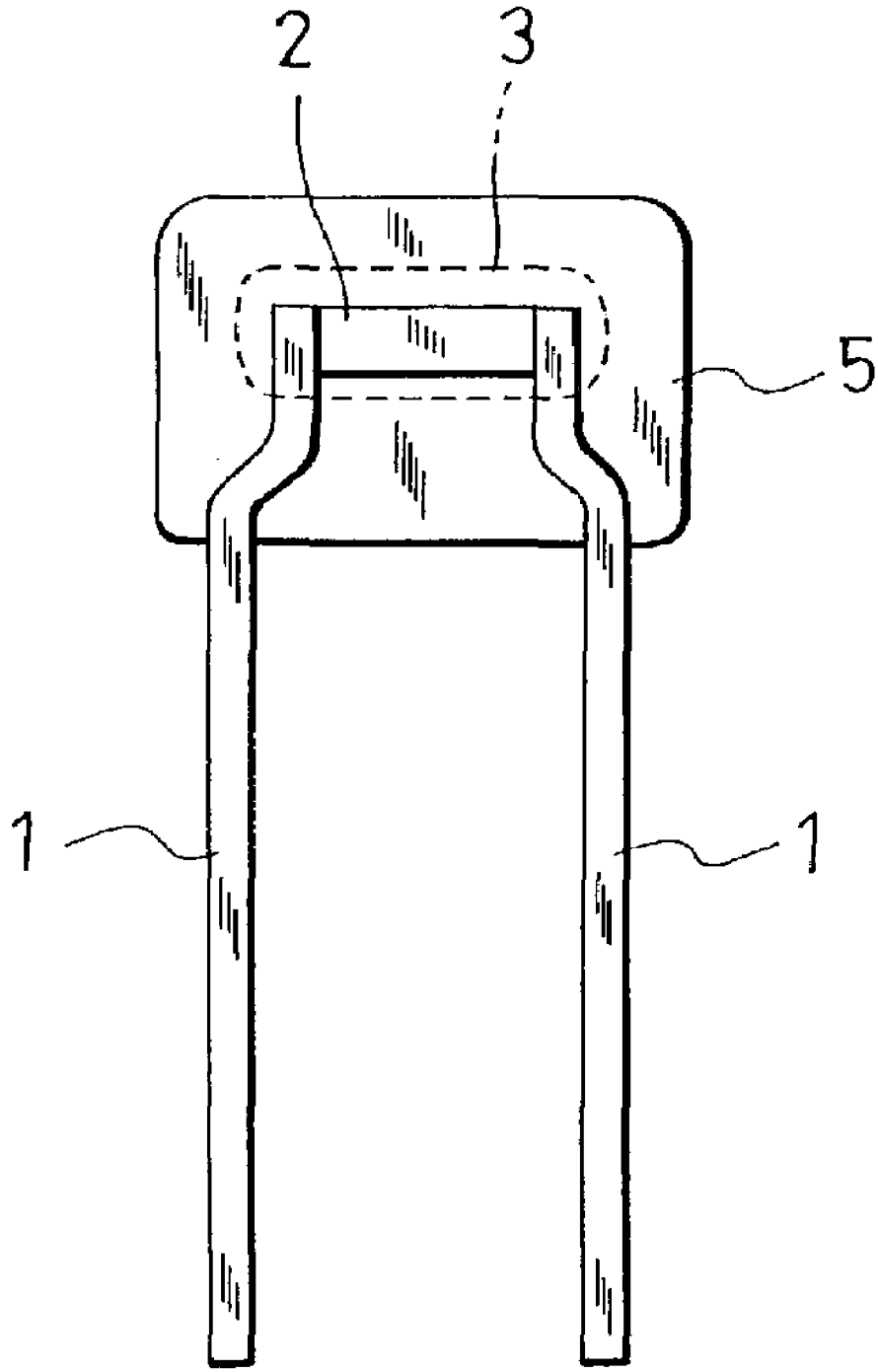
FIG. 5 is a view showing a still further example of the alloy type thermal fuse of the invention.

FIG. 5 shows a fuse of the radial resin dipping type. A fuse element 2 is bonded between tip ends of parallel lead conductors 1 by welding, and a flux 3 is applied to the fuse element 2. The flux-applied fuse element is dipped into a resin solution to seal the element by an insulative sealing agent 5 such as an epoxy resin.

The invention may be realized in the form of a fuse having an electric heating element, such as a substrate type fuse having a resistor in which, for example, a resistor (film resistor) is additionally disposed on an insulating substrate of an alloy type thermal fuse of the substrate type, and, when an apparatus is in an abnormal state, the resistor is energized to generate heat so that a low-melting fusible alloy piece is blown out by the generated heat.

As the flux, a flux having a melting point which is lower than that of the fuse element is generally used. For example, useful is a flux containing 90 to 60 weight parts of rosin, 10 to 40 weight parts of stearic acid, and 0 to 3 weight parts of an activating agent. In this case, as the rosin, a natural rosin, a modified rosin (for example, a hydrogenated rosin, an inhomogeneous rosin, or a polymerized rosin), or a purified rosin thereof can be used. As the activating agent, hydrochloride of diethylamine, hydrobromide of diethylamine, or the like can be used.

Now, embodiments of the present invention will be described in greater detail by way of example, wherein 50 specimens of the substrate type were used in measurements of the operating temperatures of Examples and Comparative Examples which will be described later, each of the specimens was immersed into an oil bath in which the temperature was raised at a rate of 1° C./min., while supplying a current of 0.1 A to the specimen, and the temperature of the oil when the current supply was interrupted by blowing-out was measured. With respect to the influence of self-heating, 50 specimens were used, and judgment was made while supplying a usual rated current (2 to 3 A) to each specimen. With respect to the change in resistance of a fuse element caused by heat cycles, 50 specimens were used, and judgment was made by measuring a resistance change after a test of 500 heat cycles in each of which specimens were heated to 120° C. for 30 minutes and cooled to −40° C. for 30 minutes.

EXAMPLE (1)

A base material of an alloy composition of 99% In and 1% Au was drawn into a wire of 300 μmϕ in diameter. The draw-down ratio per dice was 6.5%, and the drawing speed was 45 m/min. In the wire, no breakage occurred. The specific resistance of the wire was measured. As a result, the specific resistance was 18 μΩ·cm. The wire was cut into pieces of 4 mm, and small substrate type thermal fuses were produced with using the pieces as fuse elements. A composition of 80 weight parts of rosin, 20 weight parts of stearic acid, and 1 weight part of hydrobromide of diethylamine was used as a flux. A cold-setting epoxy resin was used as a covering member.

The operating temperatures of the resulting specimens were measured. The resulting operating temperatures were within a range of 156° C.±2° C. It was confirmed that, under the usual rated current, no influence of self-heating is made. Furthermore, a change in resistance of the fuse element which was caused by the heat cycles, and which may become a serious problem was not observed. The specimens exhibited stable heat resistance.

It was confirmed that, in a range of 0.01 to 7 weight parts of Au with respect to 100 weight parts of In, the thin wire drawability, the low specific resistance, and the thermal stability which have been described above can be sufficiently attained, and the operating temperature can be set to be within a range of 153° C.±5° C.

EXAMPLE (2)

A base material of an alloy composition of 95% In and 5% Bi was drawn into a wire of 300 μmφ in diameter. The draw-down ratio per dice was 6.5%, and the drawing speed was 45 m/min. In the wire, no breakage occurred. The specific resistance of the wire was measured. As a result, the specific resistance was 27 μΩ·cm. The wire was cut into pieces of 4 mm, and substrate type thermal fuses were produced with using the pieces as fuse elements in the same manner as Example (1). The operating temperatures of the resulting specimens were measured. The resulting operating temperatures were within a range of 140° C.±3° C. It was confirmed that, under the usual rated current, no influence of self-heating is made.

Furthermore, a change in resistance of the fuse element which was caused by the heat cycles, and which may become a serious problem was not observed.

It was confirmed that, in a range of 0.01 to 7 weight parts of Bi with respect to 100 weight parts of In, the thin wire drawability, the low specific resistance, and the thermal stability which have been described above can be sufficiently attained, and the operating temperature can be set to be within a range of 141° C.±5° C.

EXAMPLE (3)

A base material of an alloy composition of 98% In and 2% Cu was drawn into a wire of 300 μmφ in diameter. The draw-down ratio per dice was 6.5%, and the drawing speed was 45 m/min. In the wire, no breakage occurred. The specific resistance of the wire was measured. As a result, the specific resistance was 19 μΩ·cm. The wire was cut into pieces of 4 mm, and substrate type thermal fuses were produced with using the pieces as fuse elements in the same manner as Example (1).

The operating temperatures of the resulting specimens were measured. The resulting operating temperatures were within a range of 156° C.±1° C. It was confirmed that, under the usual rated current, no influence of self-heating is made. Furthermore, a change in resistance of the fuse element which was caused by the heat cycles, and which may become a serious problem was not observed. It was confirmed that, in a range of 0.01 to 7 weight parts of Cu with respect to 100 weight parts of In, the thin wire drawability, the low specific resistance, and the thermal stability which have been described above can be sufficiently attained, and the operating temperature can be set to be within a range of 157° C.±3° C.

EXAMPLE (4)

A base material of an alloy composition of 97.8% In, 0.2% Ni, and 2% Cu was drawn into a wire of 300 μmφ in diameter. The draw-down ratio per dice was 6.5%, and the drawing speed was 45 m/min. In the wire, no breakage occurred.

The specific resistance of the wire was measured. As a result, the specific resistance was 19 μΩ·cm.

The wire was cut into pieces of 4 mm, and substrate type thermal fuses were produced with using the pieces as fuse elements in the same manner as Example (1).

The operating temperatures of the resulting specimens were measured. The resulting operating temperatures were within a range of 156° C.±1° C. It was confirmed that, under the usual rated current, no influence of self-heating is made. Furthermore, a change in resistance of the fuse element which was caused by the heat cycles, and which may become a serious problem was not observed.

It was confirmed that, in a range of 0.01 to 7 weight parts of a total of Ni and Cu with respect to 100 weight parts of In, the thin wire drawability, the low specific resistance, and the thermal stability which have been described above can be sufficiently attained, and the operating temperature can be set to be within a range of 156° C.±3° C.

EXAMPLE (5)

A base material of an alloy composition of 97.8% In, 0.2% Pd, and 2% Cu was drawn into a wire of 300 μmφ in diameter. The draw-down ratio per dice was 6.5%, and the drawing speed was 45 m/min. In the wire, no breakage occurred. The specific resistance of the wire was measured. As a result, the specific resistance was 21 μΩ·cm. The wire was cut into pieces of 4 mm, and substrate type thermal fuses were produced with using the pieces as fuse elements in the same manner as Example (1).

The operating temperatures of the resulting specimens were measured. The resulting operating temperatures were within a range of 156° C.±2° C. It was confirmed that, under the usual rated current, no influence of self-heating is made.

Furthermore, a change in resistance of the fuse element which was caused by the heat cycles, and which may become a serious problem was not observed. It was confirmed that, in a range of 0.01 to 7 weight parts of a total of Pd and Cu with respect to 100 weight parts of In, the thin wire drawability, the low specific resistance, and the thermal stability which have been described above can be sufficiently attained, and the operating temperature can be set to be within a range of 156° C.±3° C.

EXAMPLE (6)

A base material of an alloy composition of 95% In, 3% Ag, and 2% Cu was drawn into a wire of 300 μmφ in diameter. The draw-down ratio per dice was 6.5%, and the drawing speed was 45 m/min. In the wire, no breakage occurred. The specific resistance of the wire was measured. As a result, the specific resistance was 17 μΩ·cm. The wire was cut into pieces of 4 mm, and substrate type thermal fuses were produced with using the pieces as fuse elements in the same manner as Example (1).

The operating temperatures of the resulting specimens were measured. The resulting operating temperatures were within a range of 145° C.±1° C. It was confirmed that, under the usual rated current, no influence of self-heating is made. Furthermore, a change in resistance of the fuse element which was caused by the heat cycles, and which may become a serious problem was not observed. It was confirmed that, in a range of 0.01 to 7 weight parts of Cu with respect to 100 weight parts of a composition of 90 to 99.9% In and 0.1 to 10% Ag, the thin wire drawability, the low specific resistance, and the thermal stability which have been described above can be sufficiently attained, and the operating temperature can be set to be within a range of 145° C.±3° C.

EXAMPLE (7)

A base material of an alloy composition of 96% In, 3% Ag, and 1% Au was drawn into a wire of 300 μmϕ in diameter. The draw-down ratio per dice was 6.5%, and the drawing speed was 45 m/min. In the wire, no breakage occurred. The specific resistance of the wire was measured. As a result, the specific resistance was 17 μΩ·cm. The wire was cut into pieces of 4 mm, and substrate type thermal fuses were produced with using the pieces as fuse elements in the same manner as Example (1).

The operating temperatures of the resulting specimens were measured. The resulting operating temperatures were within a range of 145° C.±1° C. It was confirmed that, under the usual rated current, no influence of self-heating is made.

Furthermore, a change in resistance of the fuse element which was caused by the heat cycles, and which may become a serious problem was not observed. It was confirmed that, in a range of 0.01 to 7 weight parts of Au with respect to 100 weight parts of a composition of 90 to 99.9% In and 0.1 to 10% Ag, the thin wire drawability, the low specific resistance, and the thermal stability which have been described above can be sufficiently attained, and the operating temperature can be set to be within a range of 143° C.±6° C.

EXAMPLE (8)

A base material of an alloy composition of 92% In, 3% Ag, and 5% Bi was drawn into a wire of 300 μmϕ in diameter. The draw-down ratio per dice was 6.5%, and the drawing speed was 45 m/min. In the wire, no breakage occurred. The specific resistance of the wire was measured. As a result, the specific resistance was 24 μΩ·cm. The wire was cut into pieces of 4 mm, and substrate type thermal fuses were produced with using the pieces as fuse elements in the same manner as Example (1).

The operating temperatures of the resulting specimens were measured. The resulting operating temperatures were within a range of 140° C.±2° C.

It was confirmed that, under the usual rated current, no influence of self-heating is made.

Furthermore, a change in resistance of the fuse element which was caused by the heat cycles, and which may become a serious problem was not observed. It was confirmed that, in a range of 0.01 to 7 weight parts of Bi with respect to 100 weight parts of a composition of 90 to 99.9% In and 0.1 to 10% Ag, the thin wire drawability, the low specific resistance, and the thermal stability which have been described above can be sufficiently attained, and the operating temperature can be set to be within a range of 140° C.±5° C.

EXAMPLE (9)

A base material of an alloy composition of 97% In, 1% Sb, and 2% Cu was drawn into a wire of 300 μmϕ in diameter. The draw-down ratio per dice was 6.5%, and the drawing speed was 45 m/min. In the wire, no breakage occurred. The specific resistance of the wire was measured. As a result, the specific resistance was 20 μΩ·cm. The wire was cut into pieces of 4 mm, and substrate type thermal fuses were produced with using the pieces as fuse elements in the same manner as Example (1).

The operating temperatures of the resulting specimens were measured. The resulting operating temperatures were within a range of 155° C.±1° C. It was confirmed that, under the usual rated current, no influence of self-heating is made.

Furthermore, a change in resistance of the fuse element which was caused by the heat cycles, and which may become a serious problem was not observed. It was confirmed that, in a range of 0.01 to 7 weight parts of Cu with respect to 100 weight parts of a composition of 95 to 99.9% In and 0.1 to 5% Sb, the thin wire drawability, the low specific resistance, and the thermal stability which have been described above can be sufficiently attained, and the operating temperature can be set to be within a range of 155° C.±2° C.

EXAMPLE (10)

A base material of an alloy composition of 98% In, 1% Sb, and 1% Au was drawn into a wire of 300 μmϕ in diameter. The draw-down ratio per dice was 6.5%, and the drawing speed was 45 m/min. In the wire, no breakage occurred. The specific resistance of the wire was measured. As a result, the specific resistance was 20 μΩ·cm. The wire was cut into pieces of 4 mm, and substrate type thermal fuses were produced with using the pieces as fuse elements in the same manner as Example (1).

The operating temperatures of the resulting specimens were measured. The resulting operating temperatures were within a range of 155° C.±1° C. It was confirmed that, under the usual rated current, no influence of self-heating is made.

Furthermore, a change in resistance of the fuse element which was caused by the heat cycles, and which may become a serious problem was not observed. It was confirmed that, in a range of 0.01 to 7 weight parts of Au with respect to 100 weight parts of a composition of 95 to 99.9% In and 0.1 to 5% Sb, the thin wire drawability, the low specific resistance, and the thermal stability which have been described above can be sufficiently attained, and the operating temperature can be set to be within a range of 153° C.±5° C.

EXAMPLE (11)

A base material of an alloy composition of 94% In, 1% Sb, and 5% Bi was drawn into a wire of 300 μmϕ in diameter. The draw-down ratio per dice was 6.5%, and the drawing speed was 45 m/min. In the wire, no breakage occurred. The specific resistance of the wire was measured. As a result, the specific resistance was 27 μΩ·cm. The wire was cut into pieces of 4 mm, and substrate type thermal fuses were produced with using the pieces as fuse elements in the same manner as Example (1).

The operating temperatures of the resulting specimens were measured. The resulting operating temperatures were within a range of 140° C.±3° C. It was confirmed that, under the usual rated current, no influence of self-heating is made.

Furthermore, a change in resistance of the fuse element which was caused by the heat cycles, and which may become a serious problem was not observed. It was confirmed that, in a range of 0.01 to 7 weight parts of Bi with respect to 100 weight parts of a composition of 95 to 99.9% In and 0.1 to 5% Sb, the thin wire drawability, the low specific resistance, and the thermal stability which have been described above can be sufficiently attained, and the operating temperature can be set to be within a range of 140° C.±5° C.

COMPARATIVE EXAMPLE (1)

In the same manner as Examples, wire drawing into a wire of 300 μmϕ in diameter was attempted with using a base material of an alloy composition of 100% In. However, wire breakage frequently occurred. Therefore, the drawdown ratio per dice was reduced to 5.0%, and the drawing speed was lowered to 20 m/min. Under these conditions of reduced process strain, wire drawing was attempted. However, wire breakage frequently occurred, and it was impossible to perform drawing.

Since a thin wire process by drawing is substantially impossible as described above, a thin wire of 300 μmϕ in diameter was obtained by the rotary drum spinning method. The specific resistance of the thin wire was measured. As a result, the specific resistance was 20 μΩ·cm. The thin wire was cut into pieces of 4 mm, and substrate type thermal fuses were produced with using the pieces as fuse elements in the same manner as Example (1). The operating temperatures of the resulting specimens were measured. As a result, it was confirmed that many specimens did not operate even when the temperature was largely higher than the melting point (157° C.).

The reason of the above is seemed as follows. Because of the rotary drum spinning method, a thick sheath of an oxide film is formed on the surface of a fuse element, and, even when the alloy inside the sheath melts, the sheath does not melt and hence the fuse element is not broken.

COMPARATIVE EXAMPLE (2)

In Comparative Example (1), an alloy composition of 97% In and 3% Ag was used. The drawing process into a thin wire of 300 μmϕ remained to be hardly performed, and therefore was inevitably realized by using the rotary drum spinning method. The results were similar to those of Comparative Example (1).

COMPARATIVE EXAMPLE (3)

In Comparative Example (1), an alloy composition of 99% In and 1% Sb was used. The drawing process into a thin wire of 300 μmϕ remained to be hardly performed, and therefore was inevitably realized by using the rotary drum spinning method. The results were similar to those of Comparative Example (1).

The advantages of the present invention are as follows:

In the alloy type thermal fuse of the invention, used is a fuse element which contains In as the main component, and in which excellent thermal stability can be guaranteed because of the intercrystalline slip preventing effect (wedge effect) due to an intermetallic compound of In and Au, Ag, Cu, Ni, Pd, or the like that is added in a range of a relative small amount or 0.01 to 7%, and a drawing process into a thin wire of 300 μmϕ is enabled. According to the invention, these advantages cooperate with the low specific resistance and the melting point characteristic of an alloy containing In as the main component, to provide a small alloy type thermal fuse which has an operating temperature of 135 to 160° C., and which is excellent in environment conservation property, operation accuracy, and thermal stability.

What is claimed is:

1. An alloy thermal fuse comprising a fuse element which is made of a low-melting fusible alloy, wherein said low-melting fusible alloy has an alloy composition consisting essentially of 0.01 to 7 weight parts of Cu per 100 weight parts of a composition of 95 to 99.9% In and 0.1 to 5% Sb.

2. An alloy thermal fuse according to claim 1, wherein said alloy composition contains inevitable impurities.

3. An alloy thermal fuse according to claim 1, wherein an operating temperature is 135 to 160° C.

4. The alloy thermal fuse according to claim 1, wherein the thermal fuse is selected from the group consisting of a substrate thermal fuse, a cylindrical case thermal fuse, a radial case thermal fuse, a tape thermal fuse, and a radial resin dipping thermal fuse.

* * * * *